United States Patent [19]

Yoshino et al.

[11] 4,442,944

[45] Apr. 17, 1984

[54] SATURATED POLYESTER RESIN BOTTLE AND STAND

[75] Inventors: Yataro Yoshino, Tokyo; Takami Tsukada, Chiba; Tadao Saito; Takamitsu Nozawa, both of Tokyo, all of Japan

[73] Assignee: Yoshino Kogyosho Co., Ltd., Tokyo, Japan

[21] Appl. No.: 422,061

[22] Filed: Sep. 23, 1982

Related U.S. Application Data

[62] Division of Ser. No. 251,530, Mar. 3, 1980, Pat. No. 4,367,820.

[51] Int. Cl.[3] ..... B65D 23/00; B65D 8/12

[52] U.S. Cl. ..... 215/1 C; 215/12 R; 215/100 R; 220/69

[58] Field of Search ..... 215/1 C, 12 R, 100 R; 220/69, 70

[56] References Cited

U.S. PATENT DOCUMENTS

| | | | |
|---|---|---|---|
| 163,747 | 5/1875 | Cummings | 220/70 X |
| 3,482,724 | 12/1969 | Heaton | 215/12 R X |
| 3,927,782 | 12/1975 | Edwards | 215/12 R X |
| 4,249,666 | 2/1981 | Hubert et al. | 215/1 C |

*Primary Examiner*—William Price

[57] ABSTRACT

The present invention relates to a saturated polyester resin bottle with a spherically-shaped bottom so that the bottle can be filled with liquid under a relatively high pressure. The bottle includes adjacent its bottom a reduced diameter portion shaped for receiving a cylindrical bottle stand which provides a flat base for supporting the bottle in an upright position.

5 Claims, 14 Drawing Figures

SATURATED POLYESTER RESIN BOTTLE AND STAND

This is a division of application Ser. No. 251,530, filed Mar. 3, 1980, U.S. Pat. No. 4,367,820.

TECHNICAL FIELD

The present invention relates to a relatively lightweight bottle formed from a saturated polyester resin and adapted to be filled with liquid such as a carbonated beverage under a relatively high pressure. More particularly, this invention relates to such a bottle in combination with a detachable bottle stand for supporting the bottle in an upright position.

BACKGROUND OF THE INVENTION

Conventionally, glass bottles have been used whenever it has been desired to fill a relatively large container with a liquid at a relatively high pressure. This is because the glass material is capable of withstanding the pressure applied thereto by the liquid. However, the weight of the liquid within the bottle, together with the inherent weight and fragility of the glass makes transportation and handling of such glass bottles extremely difficult and thus relatively costly.

Lightweight bottles formed from a saturated polyester resin material have been proposed for holding liquids such as carbonated beverages under relatively high pressures. However, these saturated polyester resin bottles must be formed with sloping or bulging contours in order to withstand satisfactorily the fluid pressure. This results in a bottle molded to have a downwardly bulging bottom incapable of supporting the bottle in an upright position ready for use. Accordingly, when such saturated polyester resin bottles are used, it is necessary to provide an independent supporting base or stand for supporting the filled bottle in an upright position. However, in the prior art, no bottle stand has been found satisfactory with regard to production cost, or with regard to capability for firmly supporting a filled and pressurized bottle in an upright position.

SUMMARY OF THE INVENTION

In accordance with the invention, a saturated polyester resin bottle is molded to have a downwardly bulging, generally spherically-shaped bottom to enable the bottle to endure a fluid charge under a relatively high pressure. The bottle includes near its bottom a reduced diameter portion for reception of a bottle stand for supporting the bottle in an upright position ready for use. The bottle stand is also formed from a saturated polyester resin to comprise a cylindrical wall for surrounding the reduced diameter portion of the bottle, and a radially inwardly projecting bottle holding portion for receiving and supporting the bottle bottom. The stand also includes a flat-surfaced base or lower end for firmly supporting the bottle in the upright position. In some embodiments of the invention, the lower end of the stand is widened for increased support area, while in other embodiments the stand is ribbed for increased strength.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
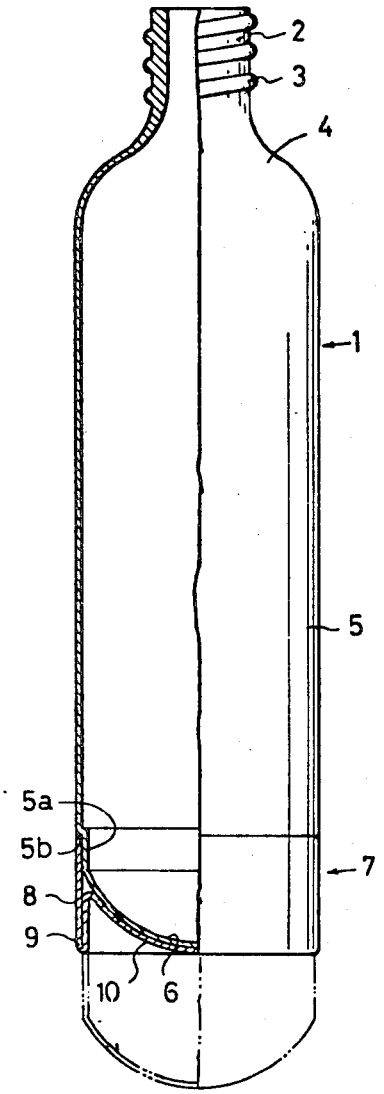
FIG. 1 is a fragmented side elevation of a saturated polyester resin bottle and stand according to the present invention.

A bottle of a saturated polyester resin according to the present invention is formed by biaxially expanding an injection-molded parison. A bottle body 1 has a mouth 2 formed with threads 3 for fastening of a cap (not shown). Below the mouth 2, a sloping shoulder 4 blends into a downwardly extending cylindrical drum 5. The lower end of the cylindrical drum 5 is closed with a bottom wall 6 which is spherically bulged downwardly. Importantly, the lower end of the drum 5 adjacent the bottom wall 6 is formed into a reduced diameter portion 5*a* to define a circumferential step 5*b*. As will be described, this reduced diameter portion 5*a* and the step 5*b* together retain the upper end of a bottle stand 7 to allow the bottle to be supported in an upright position.

The bottle stand 7 is also molded from a saturated polyester resin, and is formed into a bottom cylinder having an outer circumferential cylindrical wall 8 fitted for close reception over the reduced diameter portion 5*a* of the bottle drum 5. Accordingly, the upper end of the circumferential wall 8 is retained adjacent the step 5*b* of the bottle 1. The bottle stand 7 has an inner circumferential wall folded upwardly concentrically within the outer wall 8 to define a flat base lying on a common horizontal plane. Further, the bottle stand 7 has a generally downwardly bulging spherically shaped bottom 10 shaped to matingly receive the bottom wall 6 of the bottle such that the center portion of the stand bottom 10 lies on the common plane with the stand base.

Figure 2:
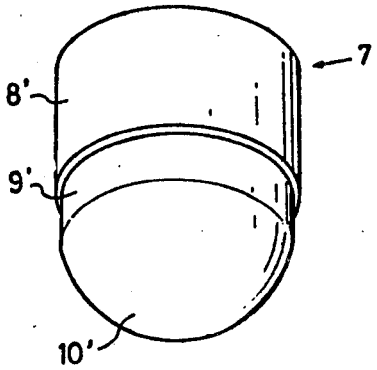
FIG. 2 is a perspective view of a bottle stand during formation thereof.

As better seen from FIG. 2, the bottle stand 7 is composed of a spherical bottom 10' for supporting the bottom wall 6 of the bottle, an outer circumferential wall 8' of a larger diameter, and an inner circumferential wall 9' of a smaller diameter. The bottle stand 7 thus composed may be vacuum-molded into a thin unitary molding from a sheet of a suitable synthetic resin. More specifically, the resulted molding is folded inwardly and upwardly as described above at the juncture between the inner circumferential wall 9' and the outer circumferential wall 8' to form the bottle stand 7 shown in FIG. 1 with a flat base.

With this invention, the saturated polyester resin bottle can be molded for excellent mechanical properties, including the desired provision of the downwardly bulding bottom wall 6. The bottle stand 7 provides a flat and solid supporting base for supporting the bottle in the upright position so that the bottle can be conveniently stored or used. Moreover, since the bottle stand 7 has its lower circumferential wall composed of the double walls 8 and 9, the bottle stand 7 is formed to have a sufficient strength to support the bottle when filled with liquid. Furthermore, molding the bottle stand 7 from a saturated polyester resin as a thin unitary structure provides a stand of remarkably lightweight and low cost.

Figure 3:
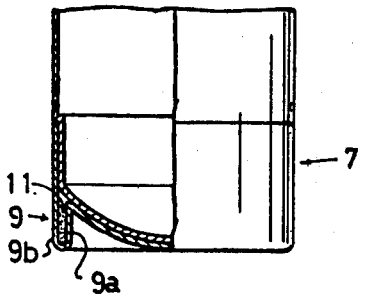
FIG. 3 is a fragmented side elevation showing a modification of the bottle stand.

As shown in FIG. 3, the bottle stand 7 may be modified to include a widened base 9 for improved supporting of the bottle in the upright position. As shown, the inner circumferential wall 9*a* is formed radially inwardly with respect to the outer wall 9*b* to define an annular space which may be filled with a suitable filler 11. In this matter, the base is widened and the filler 11 adds weight to the stand 7 to better stabilize the bottle in the upright position.

Figure 4:
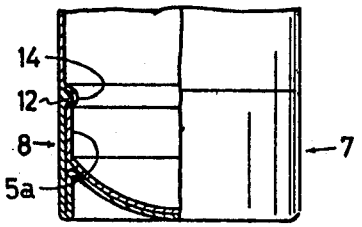
FIGS. 4 and 5 are fragmented side elevations showing embodiments in which the respective bottle stands are formed with annular projections.
Figure 5:
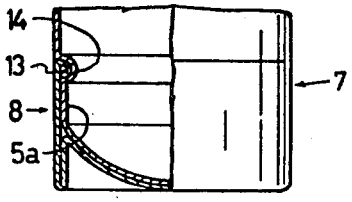

In other alternate arrangements, an annular projection 12 may be formed in the inner side of the outer circumferential wall 8 of the bottle stand 7, as shown in FIG. 4, or a hollow annular projection 13 may be formed in the same position, as shown in FIG. 5. In both instances, a mating annular groove 14 corresponding to the associated projection 12 or 13 is formed at the upper extent of the reduced diameter portion 5*a* of the bottle. With these constructions, the projection 12 or 13 is snapped into the associated annular groove 14 so as to provide a furtherstrengthened attachment between the stand 7 and the bottle 1.

Figure 6:
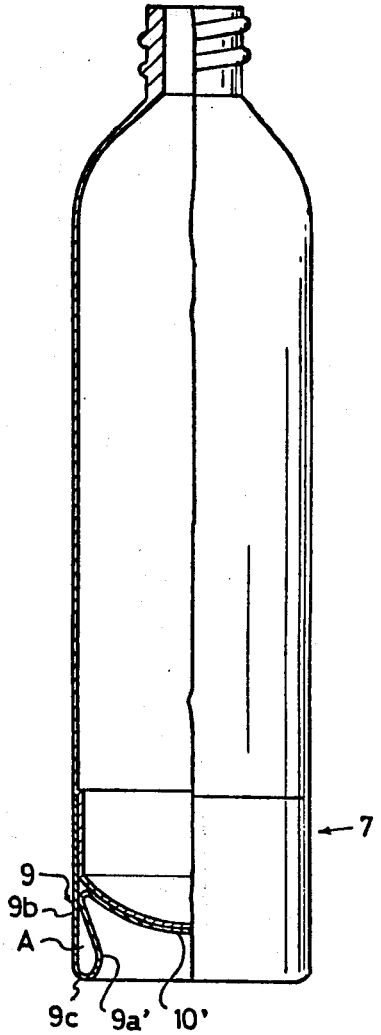
FIG. 6 is a fragmented side elevation showing a saturated polyester resin bottle and a bottle stand with a widened lower end.

As shown in FIG. 6, the bottle stand 7 may be modified to increase the area of ground contact by the bottle stand. In this embodiment, the inner circumferential wall 9*a*' of the bottle stand 7 extends upwardly in a curved fashion to define a space "A" together with the outer wall 9*b*, thus widening the base 9*c* of the stand for increased surface contact. As in the previous embodiments, the inner wall 9*a*' blends into the spherical stand bottom 10' for supporting the spherical bottom wall 6 of the bottle. However, as shown in FIG. 6, the stand bottom 10' is formed to support the bottle bottom wall 6 vertically above the plane of the stand base 9*c*. This configuration is advantageous in that the bottle is supported in a stable manner even if the supporting table or the like is vibrated, since the bottle stand 7 provides a cushioning action to prevent the vibration from toppling the bottle.

Figure 7A:
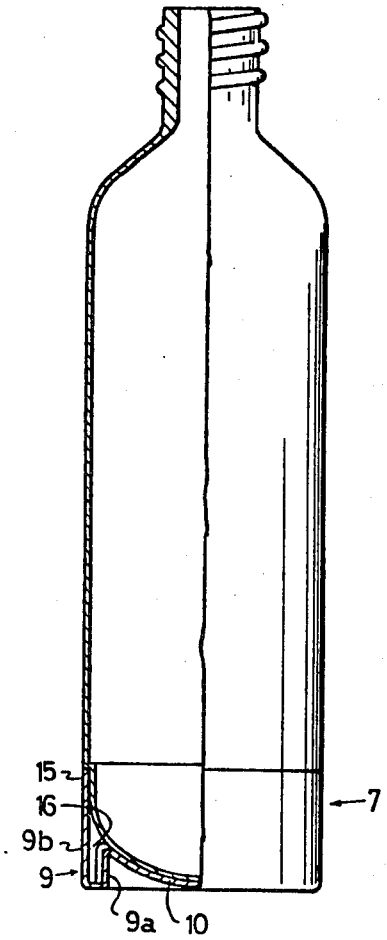
FIGS. 7A and 7B are a fragmented side elevation and a bottom view showing an embodiment with a ribbed bottle stand.
Figure 7B:
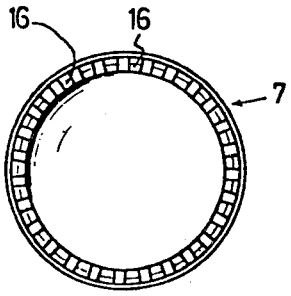

A further embodiment of the bottle stand 7 is shown in FIGS. 7A and 7B. As shown, the bottle stand 7 has its inner circumferential wall 9*a* spaced radially inwardly from the outer circumferential wall 9*b* to form an extended surface area base. The inner wall 9*a* is formed with vertically extending ribs 16 to increase the strength of the bottle stand. As shown, the ribs 16 are recessed inwardly into the spacing between inner wall 9*a* and the outer wall 9*b*. Moreover, as shown, the ribs 16 and the inner wall 9*a* together merge into the stand bottom 10 which supports the bottom wall 6 of the bottle.

Figure 8A:
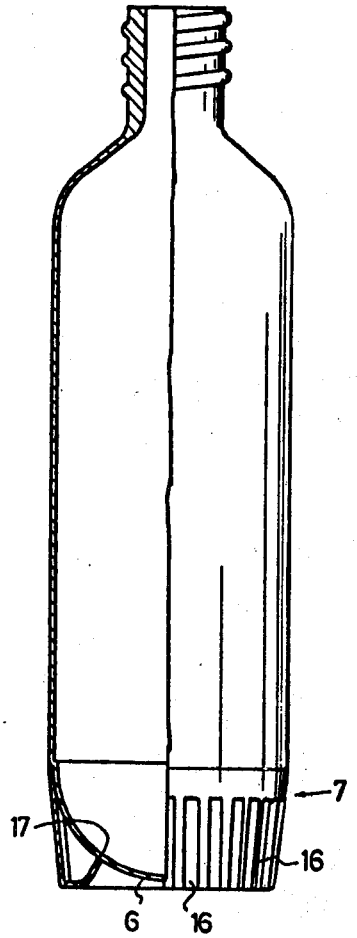
FIGS. 8A and 8B are a fragmented side elevation and a bottom view with a modified ribbed bottle stand.
Figure 8B:
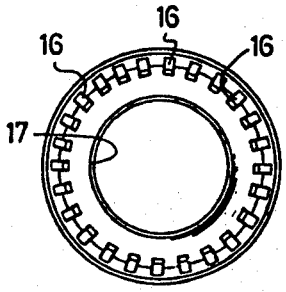

In the bottle stand 7 shown in FIGS. 8A and 8B, ribs 16 are formed on the outer circumferential wall and extend vertically to a higher position than the ribbs 16 shown in FIGS. 7A. Moreover, the stand bottom is eliminated due to the inner circumferential wall terminating in an inwardly inclined circumferential edge 17. The edge 17 is configured to stably support the bottom wall 6 of the bottle at a vertical location slightly above the plane of the base of the bottle stand 7.

Figure 9A:
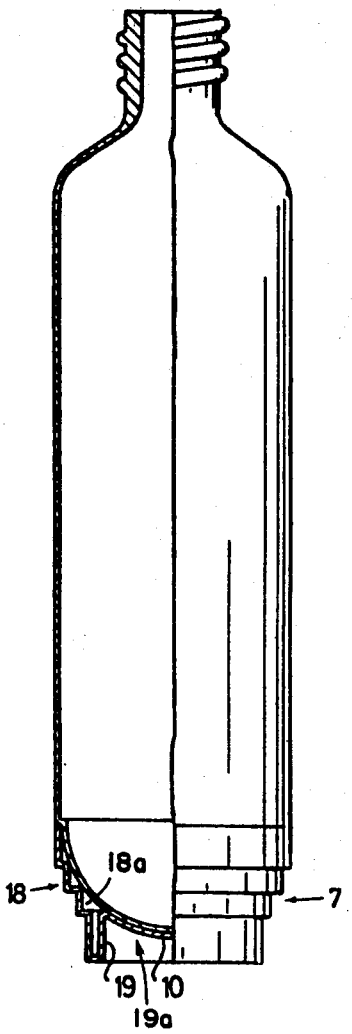
FIG. 9A is a fragmented side elevation showing a bottle with a stepped bottle stand.

Turning now to FIG. 9A, a further modified bottle stand is shown to include an outside circumferential surface and an inside surface 18*a* in the form of a plurality of reducing diameter steps. The steps reach the smallest diameter at the base of the stand 7, and are formed integrally with an upwardly directed inner reentrant circumferential wall 19 which forms a reentrant 19*a*. As in the previous embodiments, the inner reentrant wall 19 merges into a spherically-shaped stand bottom 10 for supporting the bottom wall 6 of the bottle. As shown, in this embodiment, the stand bottom 10 is in range to support the bottle bottom wall 6 at a position vertically above the plane of the base. It will be noted that the bottle rests in point line contact only with the corners of at least two of the stepped shoulders.

Figure 9B:
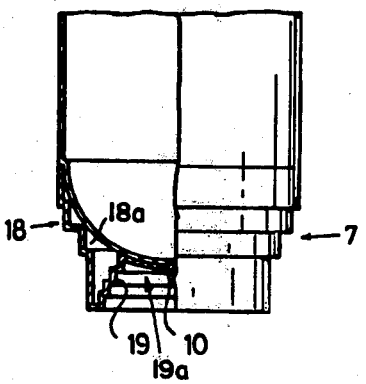
FIG. 9B is a fragmented side elevation showing a modified form of a stepped bottle stand.

In the embodiment shown in FIG. 9B, the inner reentrant wall 19 of the bottle stand 7 is also formed from a plurality of inwardly decreasing diameter steps. These steps serve to increase the overall strength of the stand with regard to resistance to transverse deformation. Moreover, the various steps enhance cushioning effects of the stand 7 so that the bottle may be more stably supported in the upright position.

Figure 10A:
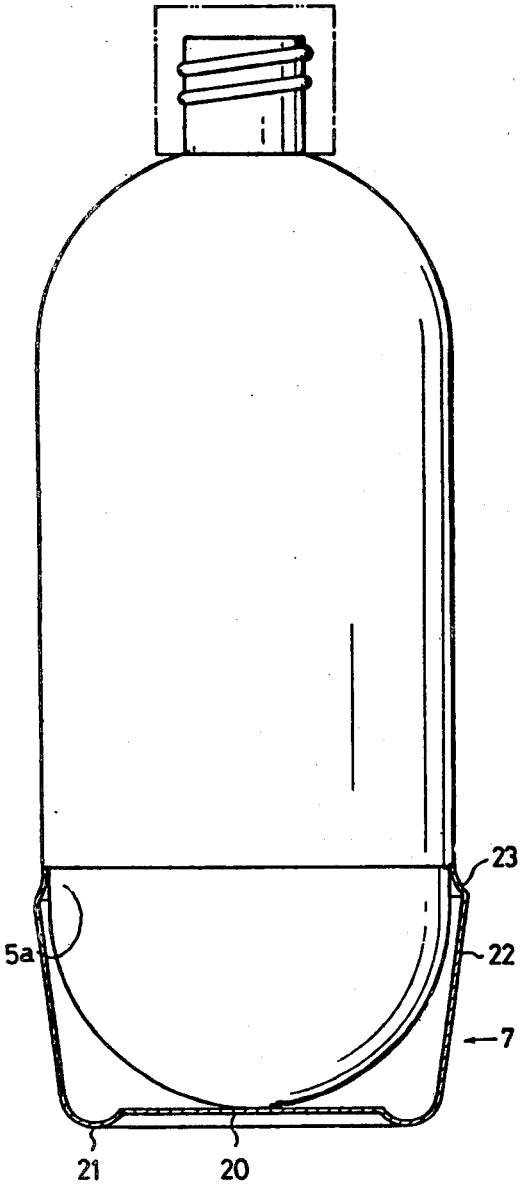
FIG. 10A is a fragmented side elevation showing a bottle with a bottle stand having a flat-surfaced lower end.

FIG. 10A illustrates an embodiment of the invention in which the bottle stand 7 is configured to have a flat bottom center portion 20 for supporting the spherical bottom wall 6 of the bottle. This flat bottom center portion 20 is generally circular in shape, and protrudes downwardly at its circumference to from an annular base 21. The base 21 blends into a cylindrical wall 22 rising upwardly and radially outwardly therefrom. The cylindrical wall 22 has its upper end formed with a radially inwardly and upwardly extending retaining edge 23 which is firmly received against a step at the upper end of the reduced diameter portion 5*a* of the bottle.

Figure 10B:
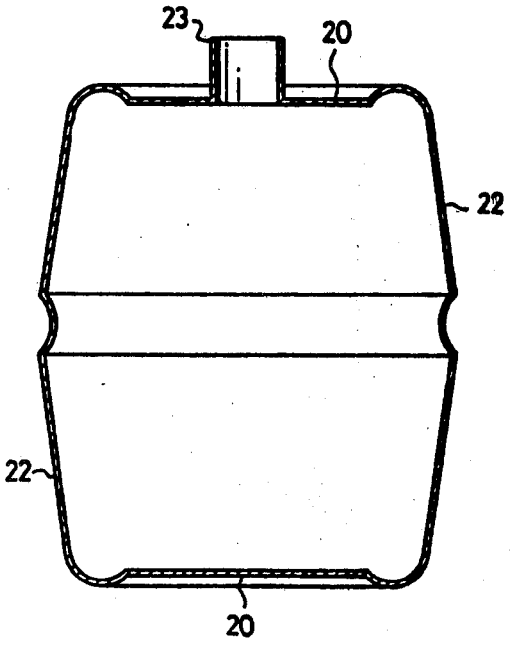
FIG. 10B is a sectional view illustrating molding of the bottle stand to be used in the embodiment of FIG. 10*a*.

The bottle stand 7 as shown in FIG. 10A is conveniently molded in pairs as illustrated in FIG. 10B. Two bottle stands 7 are formed back-to-back as a unitary molding with their retaining edges merging into each other at the center. The stands are separated by cutting the unitary molding horizontally along the center of the FIG. 10 orientation. In this instance, one half of the unitary molding is formed with a compressed air blowing port 24 for use during the molding process. Of course, this port 24 is removed prior to use of the stand.

In the embodiment described in FIGS. 10A and 10B, the base 21 of the bottle stand 7 is formed into a relatively large annulus to stably support the bottle. Once again, the flat bottom center portion 20 positions the bottom wall 6 of the bottle at a slightly higher level than the base 21 to separate the bottle from direct shock or vibration from the supporting table or the like.

We claim:

1. In combination: a bottle and a stand, said bottle comprising a body portion and a bottom, said body portion including at its top an opening and connecting at its lower most end to said bottom, said bottom being hemispherical in shape and of smaller diameter than said body portion whereby a step is defined where said bottom meets said body portion; said stand comprising an inside surface and an outside surface, said inside surface receiving said bottom, said outside surface having an upper circumference at least equal to said body portion and a narrower lower circumference said inside surface having an upper circumference at least equal to said bottom portion and a narrower lower circumference and defining between said inside upper circumference and said inside lower circumference more than two right-angled stepped shoulders such that said bottle rests in point line contact only with the corners of at least two of said stepped shoulders.

2. A hollow stand for use with a bottle, said stand comprising an upper circumference and a lower circumference, said lower circumference being narrower than said upper circumference; and side walls lying between said upper and lower circumference, said side walls defining a plurality of right-angled stepped shoulders which support in point line contact a container.

3. A stand according to claim 1 wherein said upper circumference defines the top of said stand and said lower circumference defines the bottom of said stand, said lower circumference defining in its center a reentrent having side walls and a top wall, said top wall corresponding in shape to the bottom of a bottle which rests in said stand.

4. A stand according to claim 2 wherein said upper circumference defines the top of said stand and said lower circumference defines the bottom of said stand, said lower circumference defining in its center a reentrent having side walls and a top wall, said top wall corresponding in shape to the bottom of a bottle which rests in said stand.

5. A stand according to claim 4 wherein the side walls of said reentrent form an acute angle with said lower circumference and define in their surface a plurality of right-angled stepped shoulders.

* * * * *